United States Patent [19]

Kingsford et al.

[11] Patent Number: 4,983,104

[45] Date of Patent: Jan. 8, 1991

[54] BELLOWS-TYPE PUMP

[75] Inventors: Kenji A. Kingsford, Devore; Anthony K. Chan, Alhambra, both of Calif.

[73] Assignee: Osmonics, Inc., Minnetonka, Minn.

[21] Appl. No.: 372,444

[22] Filed: Jun. 23, 1989

[51] Int. Cl.[5] ..... F04B 45/02

[52] U.S. Cl. ..... 417/473; 92/42

[58] Field of Search ..... 92/42, 103 F; 417/472, 417/473

[56] References Cited

U.S. PATENT DOCUMENTS 1,561,065 11/1925 Eggleston ..... 92/42

FOREIGN PATENT DOCUMENTS 956847 4/1964 United Kingdom ..... 417/473

*Primary Examiner*—A. Michael Chambers

[57] ABSTRACT

A bellows-type pump having a support ring positioned interiorly within the coil of the plastic bellows. The support ring is initially coiled to a diameter smaller than the normal bellows coil diameter. The free ends of the support ring have a telescopic relationship so that, when expanded to form a complete loop for supportive engagement within the bellows coil, the oppose free ends of the loop circumferentially engage one another and are positively held in telescopic engagement due to the circumferential hoop stress of the support ring.

3 Claims, 1 Drawing Sheet

BELLOWS-TYPE PUMP

FIELD OF THE INVENTION

This invention relates to a bellows-type pump and, in particular, to an improved support ring for interiorly supporting the coils of a plastic pumping bellows.

BACKGROUND OF THE INVENTION

To permit pumping of corrosive fluids such as high-temperature acids and the like, particularly in the semiconductor industry, positive displacement pumps have been developed which utilize a plastic bellows as a pumping member. Such bellows is constructed of Teflon and has a plurality of coils flexibly joined together to define an extendable and contractible sleeve, one end of which is closed, and the other end of which communicates with a source of pressurized air. This bellows is movably disposed within a pumping chamber in which the pumped fluid is alternately supplied and discharged. A drive piston is coupled between the bellows and is alternately and oppositely pressurized, such as with air, to cause alternative extension and contraction of the bellows to effect a pumping operation.

With this known pump, which is typically a double acting arrangement having a pair of bellows connected to opposite ends of and simultaneously driven by a common driver, it has been conventional to provide an interior support ring within each coil of the bellows to prevent inward collapse of the bellows during the pressurizing and pumping operation (that is, during the axial extension of the bellows). Such support ring typically comprises an elongate rod of spring material which is rolled to form a loop of a diameter slightly smaller than the interior diameter of the bellows coil. This loop is inserted into the bellows and then radially expanded so as to fill out and radially support the bellows coil. The ends of the split loop, which ends are flat, are disposed in abutting engagement with one another to hold the loop expanded and to form a substantially continuous ring for radially outwardly supporting the bellows coil. However, with this arrangement, it has been observed that the abutting ends of the support loop can become dislodged from one another. Thus, the loop tends to radially contract and the ends create edges which can effect undesired wear and possible puncturing of the thin plastic bellows.

Accordingly, this invention relates to an improved bellows-type pump which overcomes the aforementioned disadvantage. More specifically, the improved bellows-type pump of this invention incorporates an improved support ring which is positioned interiorly within the coil of the plastic bellows, which support ring is initially coiled to a diameter smaller than the normal bellows coil diameter. The free ends of the support ring have a telescopic relationship so that, when expanded to form a complete loop for supportive engagement within the bellows coil, the opposed free ends of the loop circumferentially engage one another and are positively held in telescopic engagement due to the circumferential hoop stress of the support ring. This thus greatly minimizes any tendency for the ends of the support ring to be sidewardly dislodged, and thus greatly minimizes any tendency for the bellows to become undesirable worn due to contact with the support ring ends.

Other objects and purposes of the invention will be apparent to persons familiar with pumps of this general type upon reading the following specification and inspecting the accompanying drawings.

Figures 1, 2, 3, 4:
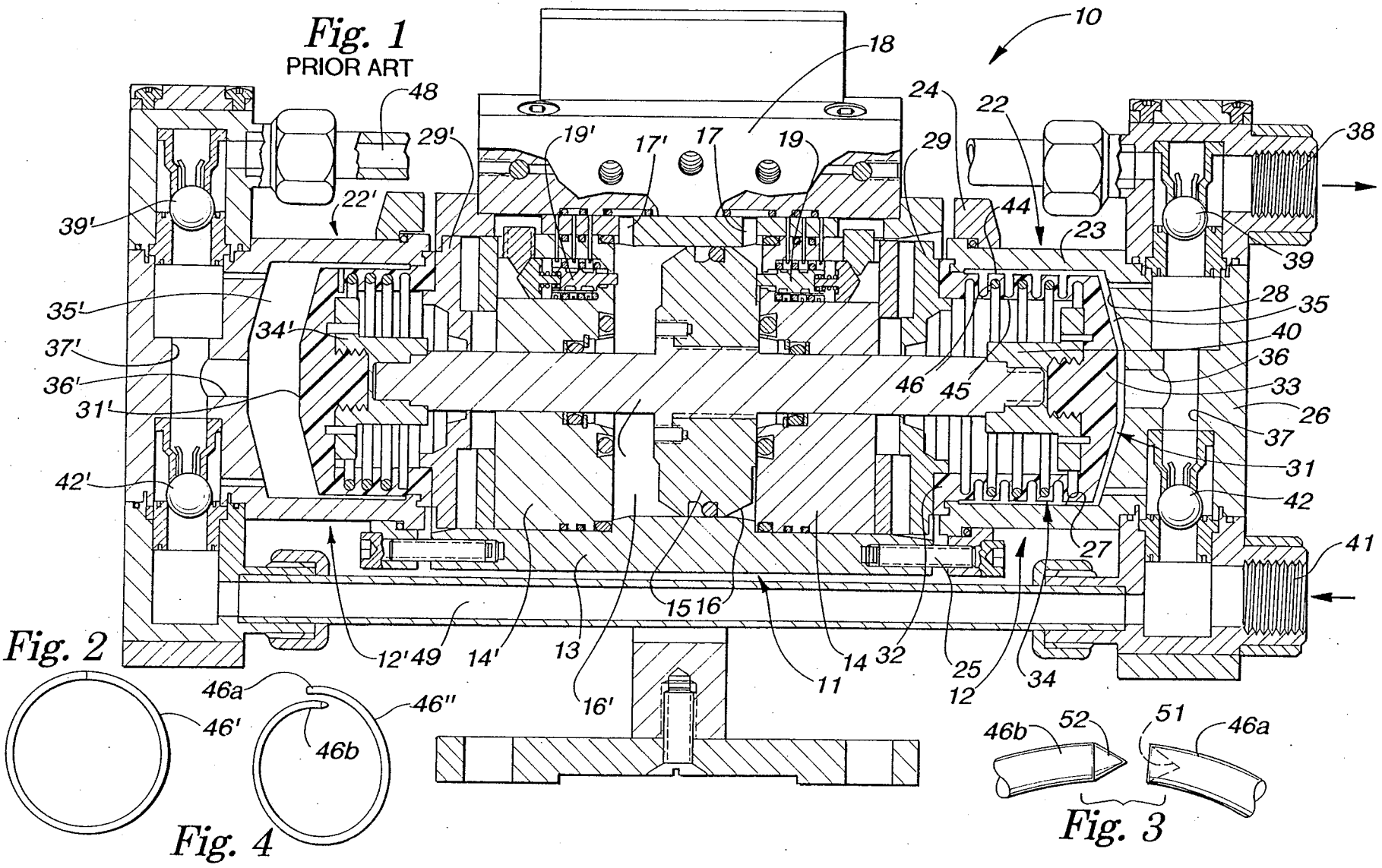
Fig. 1 PRIOR ART
FIG. 1 is a central cross sectional view of a prior art double-acting bellows-type pump.
FIG. 2 illustrates the improved support ring of this invention as incorporated into the pump of FIG. 1, the support ring being illustrated in the radially expanded and deformed condition in which it is utilized when positioned within a bellows coil.
FIG. 3 is an enlarged fragmentary view showing the ends of the support ring in a separated condition.
FIG. 4 illustrates the support condition in its nonstressed or nondeformed condition.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the pump and designated parts thereof. Said terminology will include the words specifically mentioned, derivatives thereof, and words of similar import.

DETAILED DESCRIPTION

Referring to FIG. 1, there is illustrated a prior art double-acting bellows-type pump 10, which pump is manufactured and sold by the Assignee of this application.

More specifically, the pump 10 includes a center driving section 11 for causing alternate actuation of pumping sections 12 and 12' disposed on opposite ends of the driving section.

The driving section 11 includes a housing defined by a sleevelike housing part 13 sealingly closed at opposite ends by end plates 14 and 14'. A driving piston 15 is slidably and sealingly supported within the housing part 13 and defines pressure chambers 16 and 16' on opposite sides thereof. Pressurized air is supplied to and exhausted from the chambers 16 and 16' via the respective ports 17 and 17'. These latter ports communicate with a conventional valve assembly 18, such as a conventional five-port, four-way flow valve for controlling flow of pressurized air into and out of the chambers 16 and 16'. Such valves 18 are well known so that detailed description thereof is believed unnecessary.

The shifting of the main flow control valve 18 is controlled by suitable pilot valves 19 and 19' which are respectively mounted on the end plates 14 and 14'. These pilot valves 19 and 19' comprise conventional three-way valves each having a spring-urged stem which projects outwardly into the respective chamber 16 or 16' for contact with the piston 15 to effect reversal of the main control valve 18 and hence reversal in the pressurization of the chambers 16 and 16', which in turn causes reversal in the direction of movement of the driving piston 15.

The driving piston 15 is secured to an elongate piston rod 21 which projects axially outwardly in opposite directions from the piston 15, with the piston rod projecting slidably through the end plates 14 and 14' while being maintained in sealed engagement therewith.

Considering now the pumping section 12, it includes a pump head 22 which is fixedly secured to one end of the center housing. The pump head 22 includes a generally cylindrical side wall 23 which at its inner end is coupled to a surrounding flange 24, the latter being fixed to the adjacent end of the housing part 13, such as by screws 25. The cylindrical housing sleeve 23, at its other end, terminates in a transversely extending end plate 26.

The pump head 22 defines therein a generally cylindrical chamber which is surrounded by the interior cylindrical wall 27 and which extends axially from an interior end wall 28 until terminating at an end member 29, the latter being fixed relative to the housing directly adjacent the end plate 14.

The driving section 12 includes a pumping bellows 31 disposed within the chamber of the pump head 22, which bellows 31 at its axially inner end is provided with an annular mounting flange 32 which is fixedly clamped between the housing sleeve 23 and the end plate 29. The pumping bellows at its other axial end has a transversely extending pressure wall 33. The wall 33 and flange 32 are axially joined together by an axially extendable and contractible sleevelike side wall 34, as explained below. The pressure wall 33 of the bellows is fixedly joined to a coupling plate 40 which is disposed interiorly of the bellows, and this coupling plate 40 in turn is fixedly secured to the free end of the piston rod 21, whereby the bellows is disposed so as to be generally coaxially aligned with the longitudinal axis of the piston rod.

The exterior of the bellows cooperates with the housing walls 27 and 28 so as to define a pumping chamber 35 therebetween. A supply/discharge passage 36 opens coaxially from the pumping chamber through the end wall 28 for communication with a transversely extending passage 37 as formed in the end part 26. An upper portion of this transverse passage 37 functions as a fluid discharge passage in that it communicates with a fluid discharge port 38 through an appropriate one-way check valve 39. The lower end of transverse passage 37 similarly communicates with a fluid supply port 41 through an appropriate one-way check valve 42.

As to the construction of the pumping bellows 33, it is preferably constructed in one-piece of a plastics material, preferably TFE Teflon, so as to have the capability of handling high temperature and/or corrosive fluids, such as acids. The axially extendable and contractible sleevelike side wall 34 includes a plurality of annular coils 44 which are positioned axially adjacent one another, which coils 44 have a diameter slightly smaller than the interior diameter of the cylindrical wall 27 of the pumping chamber. The coil 44, in cross section, has a generally U-shaped configuration which opens radially inwardly. The radially inner ends of the legs of adjacent coils 44 are integrally axially joined together by a flexible annular membrane or wall 45. To interiorly support the individual coils 44, each is preferably provided with a support ring 46 confined interiorly within the U-shaped cross section thereof.

The driving section 12' disposed at the other end of the pump is structurally and functionally identical to the driving section 12, and hence the parts of the section 12' are designated by the same reference numerals used to designate the corresponding parts of section 12 except for the addition of a prime (') thereto.

To facilitate the construction of the pump and particularly to minimize the number of external connections, the discharge and supply ends of the transverse passage 37' respectively communicate with intermediate passages 48 and 49, the latter in turn being respectively disposed in direct communication with the ports 38 and 41.

With the double acting pump arrangement illustrated by FIG. 1, the pumping sections 12 and 12' are driven out of phase with one another such that when the bellows 33 is being expanded rightwardly in FIG. 1 so as to pressurize the fluid in chamber 35 and discharge it outwardly through the port 38, the other bellows 33' is being contracted so as to draw fluid into the pumping chambers 35', and vice versa.

Referring now to FIGS. 2–4, there is illustrated the improved support ring 46" according to the present invention, which support ring 46" is positioned interiorly within each bellows coil 44 so as to provide an outwardly directed resilient support which hence prevents inward collapsing of the bellows due to the pressurization of the fluid within the pumping chamber 35 or 35'.

The improved support ring 46" assumes the position illustrated by FIG. 2 when in supportive engagement within the bellows coil. In this condition, the support ring 46" defines a single and substantially continuous ring which extends throughout a full 360°, and has an outer diameter which substantially corresponds to the inner diameter of the bellows coil as defined at the base of the U-shaped cross section. The support coil 46", when in this single loop configuration, has the opposed ends disposed in a nested or telescoped relation so that the opposed free ends can not be easily sidewardly displaced, and thus the support ring 46" more closely functions in a manner equivalent to a continuous non-split ring.

To achieve the above, the opposed free end parts 46*a* and 46*b* are provided with male/female configurations which respectively telescope one with respect to the other in the circumferentially extending direction of the ring. For example, the end part 46*a* has a recess 51 opening inwardly from the free end thereof, and the other end part 46*b* has a part 52 of reduced cross section projecting outwardly therefrom in the circumferential direction. This outwardly projecting part 52 is intended to snugly telescope into the recess 51 so that, when the ring is in the closed full-loop condition illustrated by FIG. 2, the interengagement of the recess 51 and projecting part 52 hence prevent the free end parts 46*a* and 46*b* from being sidewardly displaced with respect to one another.

In the illustrated embodiment, the recess 51 is of a generally conical configuration, and the part 52 is also of a generally conical configuration which tapers to an apex at the free end. However, numerous other configurations would also be suitable.

When the support ring 46" is initially formed, it is formed from a straight piece of rod, such as of spring steel, of predetermined length. It is then coiled into a loop having a diameter which is slightly smaller than the desired diameter for use in the bellows coil. When in this initially coiled and slightly smaller diameter, the end parts 46*a* and 46*b* will thus slightly circumferentially overlap as diagrammatically illustrated in FIG. 4. This slightly reduced diameter facilitates insertion of the support ring 46" into the bellows, after which it can then be radially expanded so as to be properly positioned within the interior of the selected bellows coil. The support ring 46" must be expanded, as by means of an appropriate tool, to a sufficient extent to enable the projecting part 52 to be disposed adjacent and substantially aligned with the recess 51, following which the ring can be released whereupon the hoop stress in the support ring causes it to circumferentially contract, whereby the part 52 moves into and is securely retained within the recess 51. Due to the residual hoop stress which still exists in the support ring when in the closed loop position of FIG. 2, which hoop stress is created due to the fact that the ring is initially coil about a smaller diameter as illustrated by FIG. 4, this hence tends to securely lock the telescopic end parts 51 and 52 together so as to prevent accidental sideward dislodgement thereof.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a bellows-type pump for pumping acids and the like, including a pump head defining therein an enlarged chamber, a reciprocal driver including a reciprocal driving rod projecting coaxially into said enlarged chamber, an axially elongate and flexible pumping bellows disposed in surrounding relationship to said driving rod and sealingly connected between said driving rod and said pump head so as to define a pumping chamber between said pumping bellows and opposed walls of said enlarged chamber, said bellows being constructed of a plastics material and at one end having an end wall which extends transversely across the pumping chamber and is fixedly secured to a free end of said driving rod, said bellows at the other end having an annular mounting flange which is fixedly and sealingly secured relative to the pump head, said bellows further including an axially elongate and sleevelike side wall which substantially concentrically surrounds a part of said driving rod and which extends axially between said end wall and said mounting flange, said sleevelike side wall including a plurality of axially adjacent annular coils each having a generally U-shaped cross section which opens radially inwardly, and passage means formed in said pump head and communicating with said pumping chamber for permitting a pumped fluid to be supplied into and discharged out of said pumping chamber during each reciprocal cycle of said pumping bellows, comprising the improvement wherein a split support ring is disposed within the interior of said coil to effect radially outward support of said coil in opposition to the pressurization of the pumped fluid within the pumping chamber, said support ring having a single split defined by opposed free ends which have a male-female interfitting engagement with one another to prevent the opposed ends from being directly sidewardly displaced with respect to one another.

2. A pump according to claim 1, wherein the male-female interfitting relationship between the opposed free ends of the support ring include a recess which opens inwardly from the free end of one opposed end, and a part of reduced cross section which projects outwardly from the free end of the other opposed end.

3. A pump according to claim 2, wherein said ring is initially wound into a loop having a diameter smaller than the diameter assumed by the support ring when the opposed ends are interfitted with one another, whereby the interfitted ends are maintained in snug engagement with one another due to the hoop stress in the ring which continually urges the opposed ends toward and into engagement with one another.

* * * * *